United States Patent [19]

Pantalone

[11] Patent Number: 4,680,912

[45] Date of Patent: Jul. 21, 1987

[54] STRUCTURE FOR METAL CONSTRUCTIONS IN GENERAL, IN PARTICULAR FOR TRESTLEWORK CONSTRUCTIONS, ACCOMPLISHED BY MEANS OF SECTION BARS AND JOINTING ELEMENTS

[76] Inventor: Antonio Pantalone, Via Carpaccio, 4, Milan, Italy

[21] Appl. No.: 845,558

[22] Filed: Mar. 28, 1986

[30] Foreign Application Priority Data

Apr. 5, 1985 [IT] Italy ..... 20270 A/85

[51] Int. Cl.[4] ..... E04C 3/30

[52] U.S. Cl. ..... 52/721; 52/693

[58] Field of Search ..... 52/721, 730, 732, 690–693, 52/634

[56] References Cited

U.S. PATENT DOCUMENTS 3,500,600 3/1970 Bagley, Sr. ..... 52/211

4,524,555 6/1985 Pantalone ..... 52/648 X

*Primary Examiner*—Carl D. Friedman

*Assistant Examiner*—Naoko N. Slack

*Attorney, Agent, or Firm*—Diller, Ramik & Wight

[57] ABSTRACT

A structure is proposed for metal constructions, in particular of the trestlework type, with at least an angle iron having equal legs, each one of which being extended at its free and with a first and a second extension length having a width substantially equal to half width of a leg, the first extension length being positioned at right angle relatively to the first extension length, the second extension length being positioned at right angle relatively to the first extension length, in such a direction as to depart from the other leg of the angle iron. The structure is moreover provided with jointing elements each constituted by a plate suitable to be fastened on to the angle iron at least in correspondence of the inner surface of one of its legs, and in correspondence of the inner surface of the second extension length of its second leg.

27 Claims, 30 Drawing Figures

Figure 1:
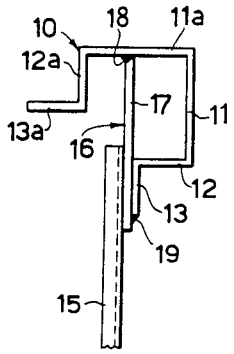

STRUCTURE FOR METAL CONSTRUCTIONS IN GENERAL, IN PARTICULAR FOR TRESTLEWORK CONSTRUCTIONS, ACCOMPLISHED BY MEANS OF SECTION BARS AND JOINTING ELEMENTS

The object of the present invention is a structure for metal constructions in general, in particular for trestlework type structures, accomplished by means of section bars and jointing elements.

It is known from the art of metal constructions that, in a correctly designed and executed joint, between stringers and section bars in general, or between stringers and wall rods (braces, uprights or crosspieces) in trestlework constructions, the barycentric axes or the tracing (drilling) axes in bolted joints must coincide, i.e., those of the wall rods must converge on the barycentric axis of the stringer to which they are fastened.

This condition however is not yet sufficient to secure that the jointing point or knot and the elements converging in it are not stressed by not negligible and hence undesired flexural and secondary actions.

For the joint to be properly accomplished, it is moreover necessary that the element jointing the stringers and the section bars, or the wall rods and the stringer, be fastened to the same stringer by means of bolts, rivets or welding beads positioned along a line coincident with the barycentric axis of the stringer, or on two lines parallel to the barycentric axis of the stringer, and lying on a plane passing through the barycentric axis, but not on the same side of the barycentric axis.

In the U.S. Pat. No. 4,524,555 of June 25, 1985 by the same Applicant, a special section bar for stringers or uprights of trestlework girders or of other metal structures is disclosed, which section bar offers several advantages over other section bars known from the prior art, such as angle irons, Hbeams, channels, and so forth. In particular, this section bar of the prior art, which is constituted by an angle iron with equal legs, each one of which is extended at its free end with a first extension length positioned at right angle relatively to the relating leg in the same direction as of the other leg, and with a second extension length positioned at right angle relatively to the first extension leg in such a direction as to depart from the other leg, with said first and second extension lengthes having each a width equal to half width of a leg of the angle iron, allows an easy fastening of the connections or jointing elements for wall rods with perfect symmetry between the two sides, has a large inertial radius and can hence have a reduced weight of its own, and allows achieving that the action lines of the forces acting through the connections or jointing elements fastening the wall rods to the stringer converge and cross each other on the barycentric axis of the section bar.

These connections or jointing elements joining these known section bars and the wall rods are indicated in the afore said patent as plates, angle slabs or the like, to be fastened by means of bolts, rivets or welding beads to said second extension lengthes of the legs of the angle iron. In this way, the action lines of the forces acting through these connections on the section bar converge and cross each other on the barycentric axis of the section bar.

However, as it has been said, in this case too, this is not enough to prevent that in the section bar parasitic flexural moments and other local actions may be induced, which can deform the cross section shape of the same section bar, increasing the danger of local and overall unstability of the structure, and hence rendering the section bar not perfectly suited to the structural uses.

Purpose of the present invention is hence to provide a structure for mechanical constructions in general, in particular for trestlework constructions, accomplished by means of profie bars and jointing elements which, while maintaining the advantages of the angle iron of the above mentioned U.S. Pat. No. 4,524,555 of June 25, 1985, allows a correct connection of said section bars with each other, and of the section bars with the wall rods, without inducting in the section bar a parasite flexural moment and other local actions which can deform the cross section shape of the same section bar.

In order to achieve this purpose, according to the present invention, such a structure is proposed for the metal constructions in general, and in particular for trestlework constructions, accomplished by means of section bars and jointing elements, characterized in that it comprises at least one angle iron having equal legs, each of which legs is extended at its free end with a first extension length positioned at right angle relatively to the related leg in the same direction as of the other leg, and with a second extension leg positioned at right angle relatively to the first extension length in such a direction as to depart from the other leg, with said first and second extension lengths having each one a width substantially equal to half width of a leg of the angle iron, and at least a jointing element constituted by at least one plate suitable to be fastened to said angle iron at least in corresponence of the inner surface of one of its legs, and in correspondence of the inner surface of the second extension length of its second leg.

A so constructed structure allows connecting in a correct way the section bars with each other, or connecting with the section bars wall rods on a plane parallel to the planes of said second leg of the angle iron and of the related second extension length.

In the simplest form of practical embodiment of such a structure, the jointing element can be constituted by one single and simple plate butt-fastened on one side by means of a welding bead to the inner surface of the said first leg of the angle iron, and fastened on the other side by welding, bolting or riveting to the inner surface of the second extension length of the second leg of the angle iron.

Instead of a simple plate, as the jointing element a plate can be provided ending, at an end, with a second plate, so as to form a T-shaped element, wherein the second plate of such an element is destined to be fastened by suitable means, e.g., bolts, rivets or the like, to the inner surface of a leg of the angle iron, possibly also by means of a double row of fastening means, whilst the first plate, or the core of the T-shaped element, is destined to be fastened by means of similar fastening means, to the inner surface of the second extension length of the other leg of the angle iron.

If the angle iron is to be connected to the other elements of the structure (wall rods, crosspieces, braces) on two planes perpendicular to each other, the jointing element shall be so accomplished as to be suitable to be fastened on one side in correspondence of the inner surfaces of both second extension lengthes of the angle iron, and on the other side at least in correspondence of the inner surface of one of the legs of said angle iron.

The structure provided according to the present invention allows achieving the fulfillment of the conditions necessary for the correct transmission of the forces in the connection points of section bars or stringers and from the wall rods (braces, uprights and crosspieces) to the section bar or stringer, without undesired effects due to the parasite flexural moments. Moreover, as the connection between stringers and wall rods occurs through an element distinct from both the stringer and the wall rod, an indirect connection is achieved, with the consequent further advantage that each element converging in the knot bears only the actions competing to it, in that it is the jointing element that which receives the actions exerted by the various rods, and discharges them correctly.

The jointing element provided in the structure according to the invention can be used also as an element for the stiffening of the angle iron in points wherein no other elements converge.

As a jointing element to be used in the structure according to the present invention, in particular in case in which to the angle iron wall rods must be fastened on two planes perpendicular to each other in order to create a tridimensional network girder, also a block, possibly provided with lightening cavities, can be used, having at least two faces perpendicular to each other, destined to be fastened to the inner surface of the two legs of the angle iron, and provided wtih two flat projections parallel to said two perpendicular faces of the block, and protruding from other two faces of the same block, said flat projections being destined to be fastened to the inner surfaces of the second extension lengthes of the angle iron. In this case, the block of the jointing element being inserted inside the space bound by the two legs and by the two first extension lengthes of the angle iron, renders the cross section of the section bar particularly indeformable, besides allowing the wall rods to be connected on two planes perpendicular to each other.

The jointing elements can also longitudinally end with a plate, or with any other generic element intended to abut against the end of the angle iron to allow any other section bar to be connected to it by means of bolts, rivets, or welds.

The jointing elements provided in the structure according to the invention can be obtained, in case they do not consist of a simple plate, by means of the welding of plates, or by casting, forging, extrusion, or by any other procedures.

In case an angle iron having equal legs is used, wherein the said first and the second extension lengthes have each one a width exactly equal to half width of a leg of the section bar, the plates(s) of the jointing element intended for being fastened to the inner surfaces of the second extension length(es) of the legs of the section bar are not precisely centred on the centre of gravity of the same section bar, remaining off-centred relatively to it by a distance equal to the sum formed by the half-width of the second extension lengthes of the legs of the section bar and by the half-thickness of the plates of the jointing element destined to be fastened to the inner surfaces of the said second extension lengthes.

To the purpose of obtaining a perfect centering, slightly modifying the widths of the first and of the second extension lengthes of the legs of the angle iron, but leaving unchanged the position of its barycentre is possible.

In particular, the first extension lengthes of the two legs of the angle iron can each be given a width equal to half width of a leg of the section bar, lessened by a value corresponding to the sum formed by half-thickness of the second extension lengthes of the legs of the section bar, plus the half-width of the plates of the jointing element destined to be fastened to the inner surfaces of said second extension lengthes, and the second extension lengthes of the two legs of the section bar can each be given a width equal to the half-width of a leg of the section bar, increased by the value of the said sum.

In this way, not only the plate(s) of the jointing element can be fastened to the inner surfaces of the second extension lengthes of the legs of the angle iron, so that the forces transmitted by the wall rods connected to said plate(s) pass through the barycentric axis of the angle section bar, but the position of the barycentre of the section bar remains unchanged relatively to the position of the barycentre of an angle iron, wherein the first and second extension lengthes of the two legs of the section bar have a width equal to half width of a leg.

It appears clear, in any case, that also with the not-modified section bar, and by using a jointing element as provided in the structure according to the present invention, considerable advantages are however achieved as compared to the situation wherein traditional jointing elements are used, because the off-centering distance of the plate(s) of the jointing element from the centre of gravity of the section bar remains in any case very small, so as not to induce appreciable negative consequences.

Figure 1A:
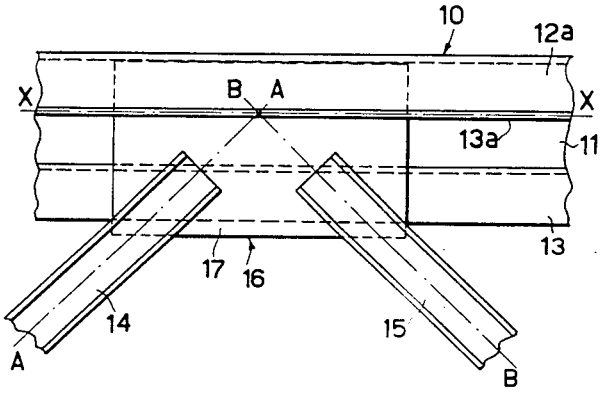
Figure 4:
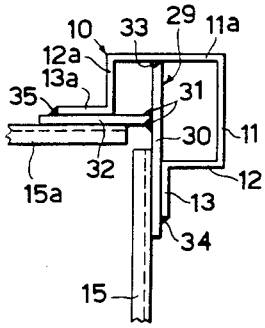
Figure 4A:
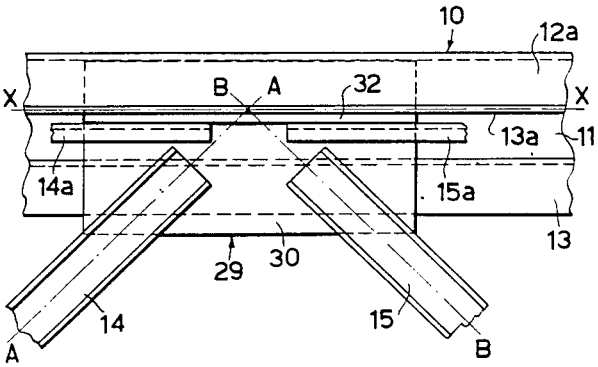

In the following, the invention shall be disclosed in greater detail with reference to the attached drawings showing various forms of practical embodiment exemplifying and not limitative of the same invention, and namely FIGS. 1-1*a* show in respectively front view and side view a first form of practical embodiment of a structure with a stringer and diagonal wall rods lying on one plane only, FIGS. 2-2*a* and 3-3*a* are analogue views of two constructional variants of the structure as of FIGS. 1-1*a*, FIGS. 4-4*a* are analogue views of a structure with a stringer and diagonal wall rods on two perpendicular planes;

FIGS. 5-5*a*, 6-6*a*, 7-7*a*, 8-8*a* and 9-9*a* are views of constructional variants of the structure as of FIGS. 4-4*a;*

FIGS. 10-10*a* and 11-11*a* show further constructional variants of the structure as of FIGS. 4-4*a;*

Figure 12:
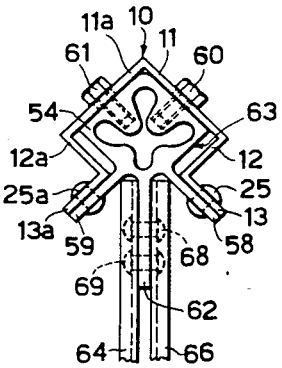
Figure 12A:
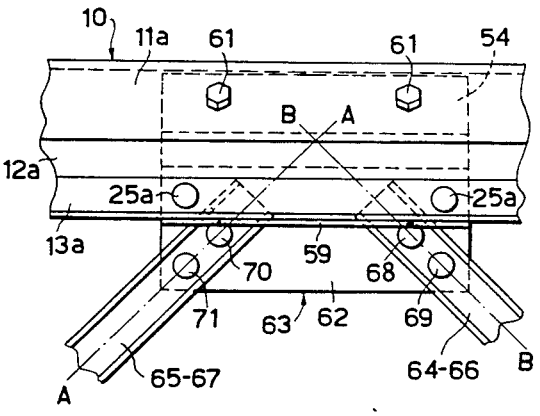
Figure 13:
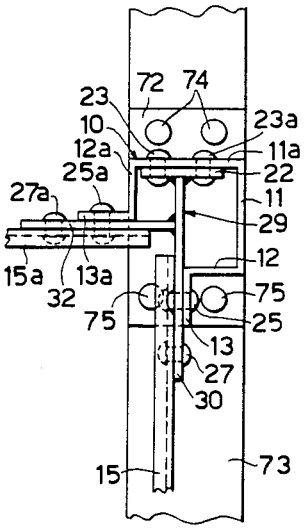
Figure 13A:
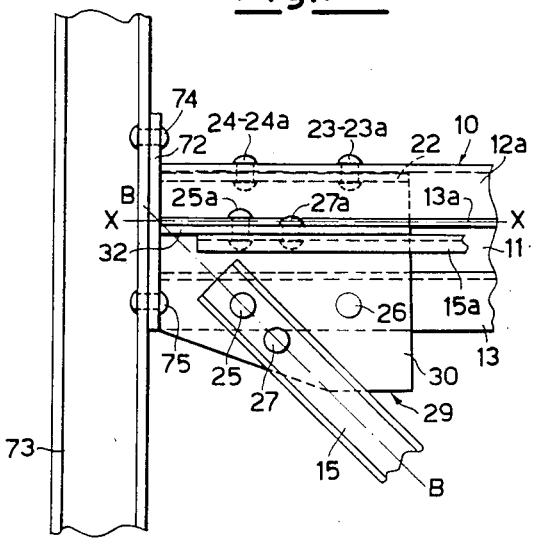
Figure 14:
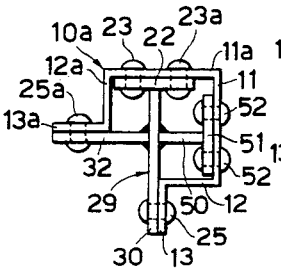
Figure 14A:
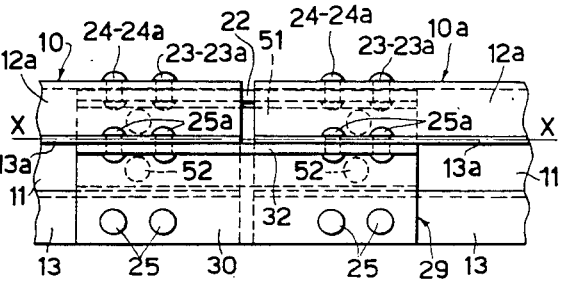
Figure 15:
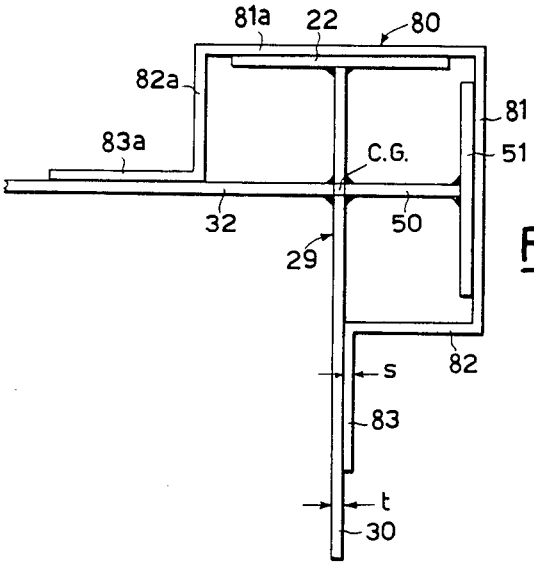
Figure 16:
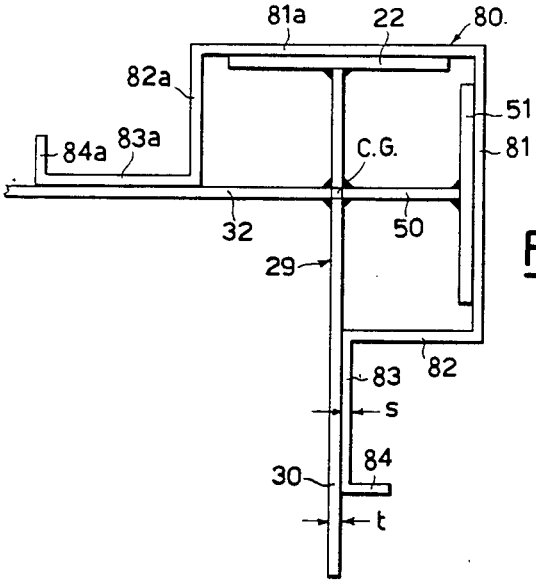

FIGS. 12-12*a* show another form of practical embodiment of a structure with a stringer to which elements lying on plane inclined by 45° relatively to the legs of the angle iron are connected;

FIGS. 13-13*a* show a structure wherein to a stringer, besides wall rods lying on two perpendicular planes being connected to it, a further section bar is butt-jointed;

FIGS. 14-14*a* show the connection of two equal section bars with each other;

FIG. 15 shows in front view a structure comprising a modified angle iron and a jointing element for jointing wall rods lying on two perpendicular planes, and FIG. 16 shows, in a view similar to FIG. 15, another type of modified angle iron.

Referring first to FIGS. 1-1*a*, in them a structure is shown, which comprises an angle iron, generally indicated with 10, and a jointing element, generally indicated with 16.

The angle iron 10 has two legs 11 and 11*a* of equal width, and each of these legs is extended at its free end with a first extension length 12 and respectively 12*a*, and with a second extension length 13 and respectively 13a. The first extension lengthes 12 and 12*a* are perpendicular to their respective legs 11, 11*a* of the angle iron 10 and are positioned in the same direction as of the other respective leg 11a, 11 of the section bar. The second extension lengthes 13 and 13*a* are perpendicular to their respective first extension lengthes 12 and 12*a* and are positioned in such directions as to depart from the respective other leg 11*a*, 11 of the angle iron 10. Each of said first and second extension lengthes 12, 12*a* and 13, 13*a* of the section bar 10 has a width of equal to half width of a leg 11 or 11*a* of the same section bar.

The jointing element 16 is constituted, in this simplest form of embodiment, by a simple plate 17 buttwelded in 18 to the inner surface of the leg 11*a* of the section bar 10, and abutting against the inner surface of the second extension length 13 of the other leg 11 of the section bar, to which length 13 it is welded by means of a welding bead 19.

The junction element 16 can be used to connect to the section bar or stringer 10 two elements 14, 15, suitable fastened, e.g., also welded, to the junction element 16 and so inclined that their barycentric axes A—A and respectively B—B cross each other on the barycentric axis X—X of the section bar 10 (see FIG. 1*a*).

Figure 2:
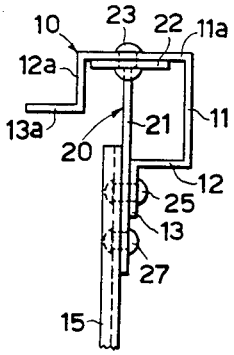
Figure 2A:
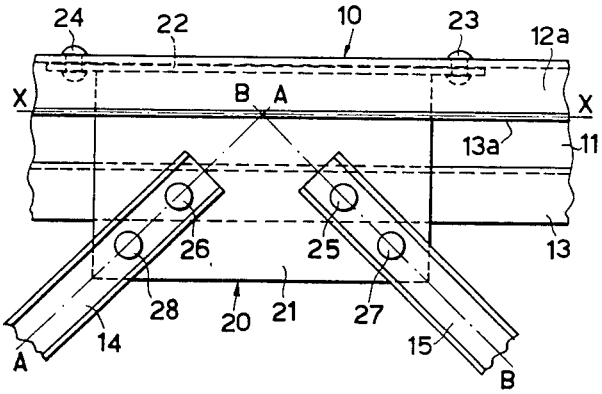

Another form of embodiment of the structure, wherein always the same angle iron 10 as shown in FIG. 1-1*a* can be used, is shown in FIG. 2-2*a*, and contains a T-shaped jointing element 20, comprising a plate 21 with which a second plate 22 perpendicular to the first plate 21 has been made butt-solid, e.g., by butt-welding. In this case, the plate 22 is fastened to the inner surface of the leg 11*a* of the section bar 10, e.g., by two rivets or bolts 23, 24 lined-up on the centre-plane of the plate 21, and the plate 21 is fastened to the inner surface of the second extension length 13 of the leg 11 of the section bar 10 by means of a couple of rivets or bolts 25, 26. To the plate 21 of the T-shaped jointing element 20, which plate suitably protrudes beyond the second extension length 13 of the secton bar 10, the elements 14 and 15 are fastened by means of the same rivets or bolts 25, 26 and further rivets 27, 28, so that their barycentric axes A—A and B—B converge on the barycentric axis X—X of the profile bar 10.

Figure 3:
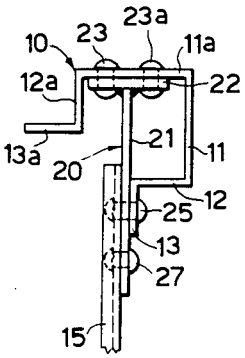
Figure 3A:
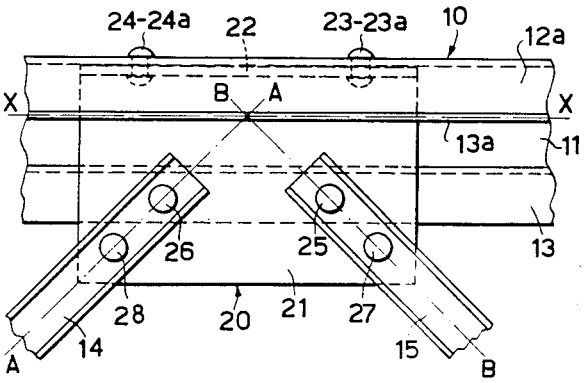

A form of embodiment analogue to that shown in FIG. 2-2*a* is shown in FIG. 3-3*a* and is different from the foregoing only because the plate 22 of the T-shaped jointing element 20 is fastened on the inner surface of the leg 11a of the section bar 10 by means of two rows of rivets or bolts 23 , 24 and 23*a*, 24*a*, with the rivets or bolts 23 and 24 and 23*a* and 24*a* being respectively positioned along two lines parallel to the barycentric axis X—X of the section bar 10 and lying on parallel and equidistant planes, but on opposite sides, relatively to the centre-plane of the plate 21 of the T-shaped jointing element 20.

FIGS. 4-4*a* show an example of structure providing the jointing to the section bar or stringer 10 as of the former figures, of wall rods on two perpendicular planes, to provide a tridimensional network beam.

In this case, the jointing element 29, in a simpler form, can be constituted by a T-shaped element with a plate 30 butt-fastened, e.g., by means of welding beads 31, to a second plate 32. The plate 30 is butt-fastened, e.g., by means of a welding bead 33, to the inner surface of the leg 11*a* of the section bar 10, abuts against the inner surface of the second extension length 13 of the other leg 11 of the section bar 10 and is fastened to this length 13 by, e.g., a welding bead 34. On the contrary, the plate 32 abuts against the inner surface of the second extension length 13*a* of the leg 11*a* of the section bar 10 and is fastened to this length 13*a* by, e.g., a welding bead 35. As it can be seen,in this case, to the plate 30 of the jointing element 29, two elements 14, 15, which lie on a plane parallel to the leg 11 of the section bar 10, can be suitable fastened, e.g., by welding, whilst to the plate 32 of the junction element 29 other two elements 14*a*, 15*a*, which lie on a plane perpedndicular to the plane containing the elements 14 and 15 can be suitably fastened, e.g., by welding.

The examples of practical embodiment shown in FIGS. 5-5*a* and 6-6*a* are analogue to those of FIGS. 4-4*a*, with a jointing element 29 for the connection of elements or wall rods 14–15 and 14*a*–15*a* on two perpendicular planes, and these examples of practical embodiment resemble, as for the way of fastening the jointing element 29 to the inner surface of the leg 11a of the section bar 10, to the forms of embodiment shown in FIGS. 2-2*a* and 3-3*a* respectively. The parts equal or having the same functions as in the former examples of practical embodiment are hence indicated with the same reference numerals. The reference numerals 25*a*–26*a* and 27*a*–28*a* are added to indicate the rivets or bolts for the fastening respectively of the plate 32 to the inner surface of the second extension length 13*a* of the leg 11*a* of the section bar 10, and of the elements 14*a*, 15*a* to the plate 32 of the jointing element 29 (see FIGS. 5-5*a* and FIGS. 6-6*a*).

Figure 5:
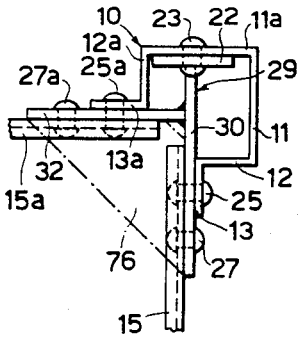
Figure 5A:
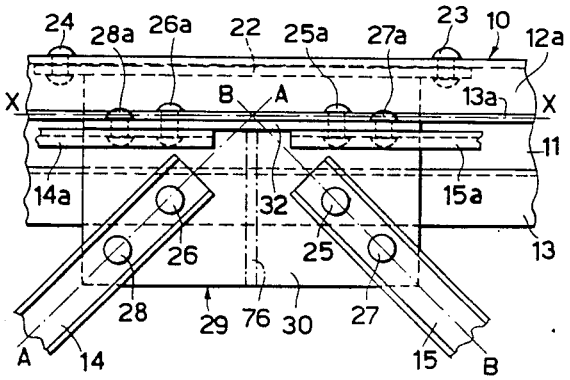
Figure 7:
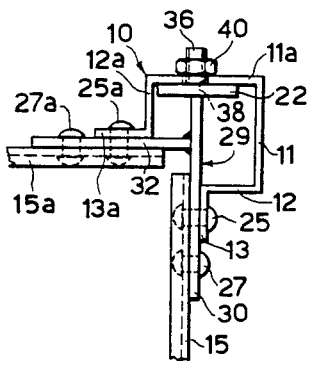
Figure 7A:
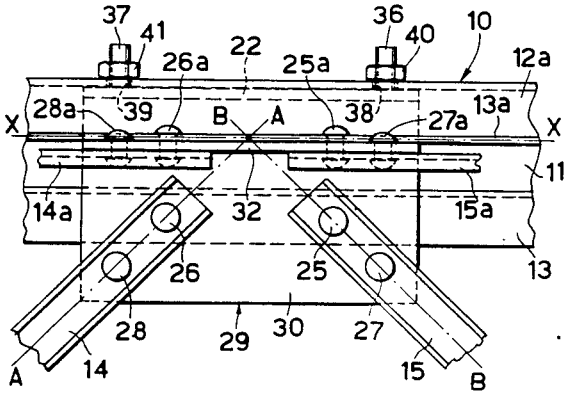

FIGS. 7-7*a* show a further example of practical embodiment similar to that shown in FIGS. 5-5*a*, with the only difference that the plate 22 of the jointing element 29, instead of being fastened to the leg 11*a* of the section bar 10 by means of rivets or bolts 23, 24, is equipped with bolts 36, 37 suitable to be passed through suitable bores 38, 39 provided on the leg 11*a* of the section bar 10, on said bolts 36, 37 fastening nuts 40, 41 being screwed down.

The same fastening way could be provided also in the examples of practical embodiment shown in FIGS. 2-2*a*, 3-3*a*, and 6-6*a*.

Figure 8:
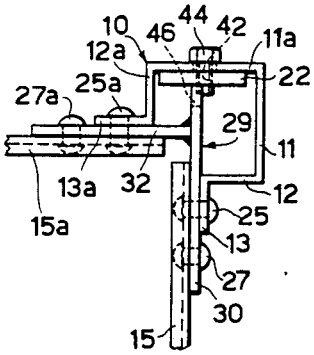
Figure 8A:
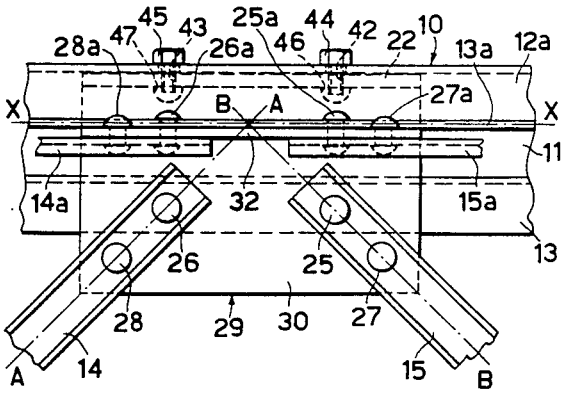

A further possibility analogue to that as of FIGS. 7-7*a* is shown in FIGS. 8-8*a*, wherein the plate 22 performs the function of nut, by being provided with threaded bores 42, 43, into which bolts 44, 45, passing through corrsponding non-threaded holes provided on the leg 11*a* of the section bar 10 are screwed down. Proper clearances 46, 47 are provided in this case in the plate 30, to allow the bolts 44, 45 to be completely screwed down in the threaded bores 42, 43 of the plate 22 of the jointing element 29.

Figure 6:
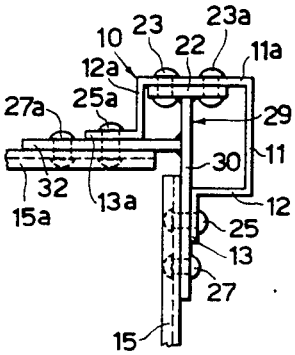
Figure 6A:
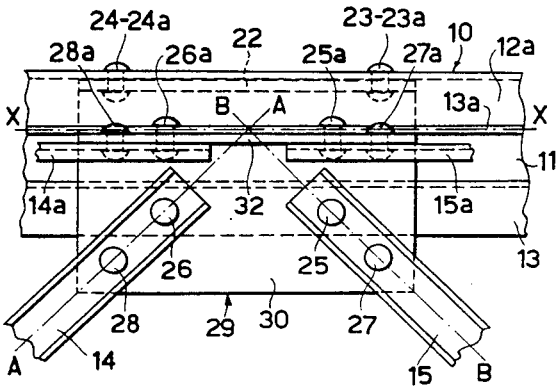
Figure 9:
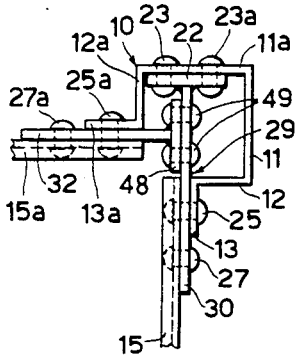
Figure 9A:
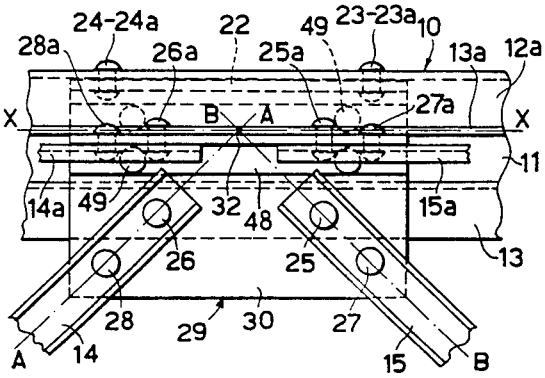

FIGS. 9-9*a* show an example of practical embodiment similar to that as of FIGS. 6-6*a*, with the only difference that the two plates 30 and 32 of the jointing element 29, instead of being jointed by welding, are connected by riveting or bolting. In this case, the plate 32 is provided, by butt-fastening, with a perpendicular plate 48, which abuts against the plate 30 and is made solid with it by means of rivets or bolts 49.

Figure 10:
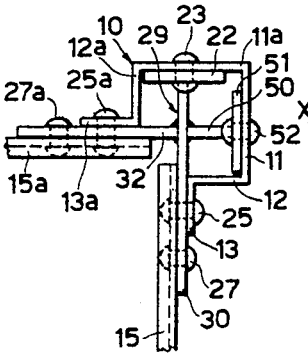
Figure 10A:
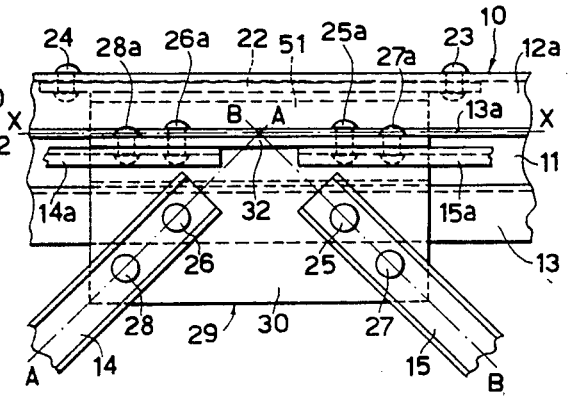

FIGS. 10-10*a* show an example of practical embodiment analogue to that of FIGS. 5-5*a*, wherein the jointing element 29 is provided, as an extension of the plate 32, and on the opposite side of the plate 30, with a further plate 50, the end of which is butt-fastened to a perpendicular plate 51, abutting against the inner surface of the leg 11 of the section bar 10, to which leg 11 the plate 51 is fastened by means of rivets or bolts 52 in a way analogue to that by which the plate 22 perpendicular to the plate 30 is fastened to the leg 11*a* of the section bar 10.

The fastening of the plate 51 to the leg 11 of the section bar 10 could be accomplished also by means of a double row of rivets or bolts, as shown in FIGS. 6-6*a* for the fastening of the plate 2 to the leg 11*a* of the section bar 10.

In the jointing element 29 shown in FIGS. 10-10*a*, all the plates 30, 32, 22, 50 and 51 are connected with each other by means of suitable welds.

Figure 11:
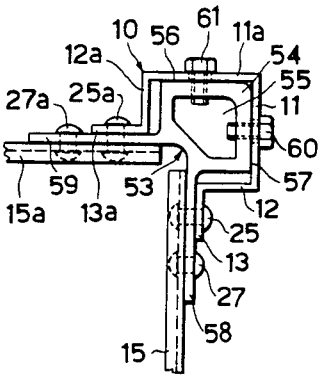
Figure 11A:
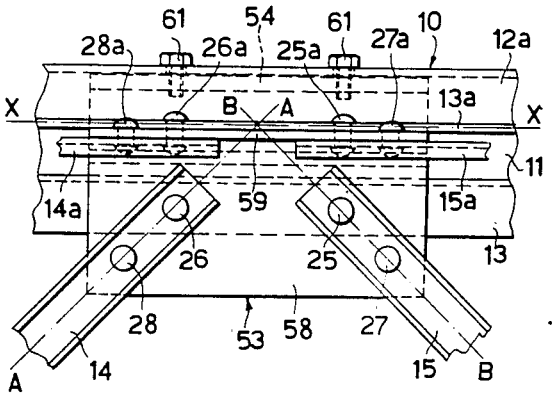

FIGS. 11-11*a* show an example of practical embodiment in which a jointing element 53 is provided, which is constituted by a block 54, suitably provided with lightening cavities 55, and having two outer faces 56, 57 perpendicular to each other, destined to abut against the inner surfaces of the legs 11 and 11a of the section bar 10. Formed as one single piece with this block 54 and protruding from it on perpendicular planes parallel to the outer faces 56, 57 of the same block, two plates 58, 59 are moreover provided, destined to abut respectively against the inner surfaces of the second extension length es 13, 13*a* of the legs 11, 11*a* of the section bar 10, to which lengthes 13, 13*a* the plates 58, 59 are fastened by means of rivets or bolts 25, 26 and respectively 25*a*, 26*a*. To the plates 58, 59 the wall rods 14, 15 and 14*a*, 15*a* are in their turn fastened by means of the rivets or bolts 25, 26, 25*a*, 26*a*, as well as by means of rivets or bolts 27, 28, 27*a*, 28*a*, as already described with reference to FIGS. 5-5*a*.

The block 54 is fastened in its turn to the legs 11, 11a of the section bar 10 by means of bolts 60, 61 passing through suitable bores provided on said legs 11, 11*a* and screwed down in threaded bores provided in the same block.

The shaping of the block 54 can be different from that shown, in order to obtain a higher lightening, and to secure a regular force line flow, provided that the block has the two perpendicular faces 56, 57 destined to abut against the inner surfaces of the legs 11, 11*a* of the section bar 10. The block 54 could however be also solid.

As shown in the example of practical embodiment shown in FIGS. 12-12*a*, providing is also possible on a block 54 of type analogue to that of FIGS. 11-11*a* a protruding plate 62 positioned on a centre-plane between the plates 58 and 59. If such a block 54 is mounted on and fastened to the section bar 10 by means of bolts 60, 61 and rivets or bolts 25, 25*a*, as shown in FIG. 12, the plate 62 of the block 54 lies on a plane passing through the gravity centre of the section bar 10 and inclined by 45° relatively to the legs 11, 11*a* of the same section bar. A jointing element 62 of this kind allows connecting to the section bar 10 other elements, such as the elements 64, 65 and 66, 67, to be fastened by means of suitable rivets or bolts 68-69 and 70-71 to said plate 62.

All the junction elements illustrated up to now can longitudinally end with a plate 72, as shown in FIGS. 13-13*a* for a junction element 29 of the type shown in FIGS. 6-6*a*, to allow to the section bar 10 another section bar whatsoever, e.g., an H-beam 73, to be connected, by rivets or bolts 74, 75, or by welds. This plate 72 is butt-welded to the plates 30, 32 and 22 of the jointing element 29 and frontally abuts against the end of the section bar 10. The fastening of the jointing element 29 to the section bar 10 can occur as already described with reference to FIGS. 6-6*a*. Instead of the plate 72, another suitable element could be provided.

FIGS. 14-14*a* show to exemplifying purposes the use of a jointing element 29 analogue to that shown in FIGS. 10-10*a*, to the purpose of butt-connecting two section bars 10 and 10*a* with each other. In this case, the plate 22 of the jointing element 29 is fastened by means of rivets or bolts 23, 24 and 23*a*, 24*a* to the inner surfaces of the legs 11*a* of the two near section bars 10 and 10*a*, the plate 51 is fastened by rivets or bolts 52 to the inner surface of the legs 11, the plate 30 is fastened by rivets or bolts 25 to the inner surfaces of the second extension lengthes 13 of the legs 11 of the two section bars 10, 10*a* and the plate 32 is fastened by rivets or bolts 25*a* to the inner surfaces of the section extension lengthes 13*a* of the legs 11a of the two section bars 10, 10*a*.

It can be realized that as the element for jointing abutting lined-up section bars 10, 10*a*, also a junction element of such type as that illustrated in FIGS. 11-11*a* could be used.

As shown by long chain lines in FIGS. 5-5*a*, nothing forbids to weld stiffening ribs 76 on the plates 30 and 32 of the junction element 29 (or also on the plates 58 and 59 of the junction element 53 of FIGS. 11-11*a*), without that however the principle of the invention be impaired.

All the junction elements as disclosed can be obtained by welding plates, or by casting, forging, extrusion, on in any other way from metal materials, such as iron, steel, aluminium or their alloys.

It must be also pointed out that the various ways of fastening the junction elements to the section bars and the wall elements or rods to the junction elements, shown to exemplifying purposes, can be swapped and/or combined with each other in various patterns.

In the structures as described up to now, an angle iron of the type wherein the first and second extension have each a width equal to half width of a leg of the angle iron has always been used.

In this way, it can be observed that the plate 17 of the junction element 16 of FIGS. 1-1*a*, the plate 21 of the junction element 20 of FIGS. 2-2*a* and 3-3*a*, the plates 30 and 32 of the junction element 29 of FIGS. 4-4*a*, 5-5*a*, 6-6*a*, 7-7*a*, 8-8*a* and 9-9*a*, the plates 30, 32 and 50 of the junction element of FIGS. 10-10*a*, and the plates 58 and 59 of the junction element 53 of FIGS. 11-11*a* and 12-12*a*, remain slightly off-centred relatively to the centre of gravity of the angle iron 10.

If one desires that the above said plates of the junction elements are centred relatively to the centre of gravity of the section bar, without however that such a centre of gravity changes in its position, then the widths of the first and second extension lengthes of the equal legs of the angle iron must be varied.

This modification is described hereunder, referring to FIGS. 15 and 16.

The angle iron 80 shown in FIG. 15 has it too two equal legs 81 and 81*a*, which legs are each extended, in correspondence of their free ends, with a first extension length 82 and respectively 82*a* positioned at right angle relatively to its related leg 81 and respectively 81*a* in the same direction as of the other leg 81*a* and respectively 81, and with a second extension length 83 and respectively 83*a* positioned at right angle relatively to the first extension length 82 and respectively 82*a* in such a direction as to depart from the other leg 81*a* and respectively 81. However, these first and second extension lengthes 82, 82*a* and 83, 83*a* do not have each a width exactly equal to half width of one leg 81 or 81*a* of the angle iron 80, but the first extension lengthes are slightly less wide and the second extension lengthes are correspondigly wider. The lessening and respectively the increase in width of the said extension lengthes depend, on one hand, on the wall thickness of these lengthes and hence of the whole angle iron (because its legs and extension lengthes have the same part thickness), and, on the other hand, on the wall thickness of the plates of the junction element destined to be fastened to the inner surfaces of the second extension lengthes of the same angle iron.

In particular, the first extension lengthes 82, 82*a* of the legs 81, 81*a* of the angle iron 80 have each a width equal to half width of a leg 81 or 81*a* of the section bar, lessened by a value corresponding to the sum formed by the half-thickness s of the second extension lengthes 83, 83*a* of the legs of the section bar and by the half-thickness t of the plates 30, 32 of the junction element 29 destined to be fastened to the inner surfaces of said second extension lengthes 83 and respectively 83*a*. (In the example of practical embodiment shown in FIG. 15, to the angle iron 80 a junction element 29 of the type as described above with reference to FIGS. 10-10*a* is fastened).

By this contrivance, it can be achieved that the plates 30 and 32 of the junction element 29 are centred relatively to the centre of gravity, indicated with the "C.G." in FIG. 15.

But, to the purpose of obtaining that, also with reduction in width of the first extension lengthes 82, 82*a*, the centre of gravity C.G. of the section bar maintains unchanged its position relatively to an angle iron wherein the first and the second extension lengthes of the two legs have each a width exactly equal to the half width of a leg of the section bar, increasing the width of the second extension lengthes 83, 83*a* is necessary, in such a way that said second extension lengthes have each a width equal to the half width of a leg 81 or 81*a*, increased by a value corresponding to the said sum $s/2+t/2$.

As it can be observed in FIG. 15, thanks to this slight modification, it can be achieved that the plates 30, 32 of the junction element 29 fastened to the inner surfaces of the second extension lengthes 83, 83*a* pass with their centre planes exactly through the centre of gravity C.G. of the angle iron 80, while this centre of gravity maintains its position unchanged as compared to a section bar of the type as of FIG. 10 shown in the former figures.

A form of embodiment of the section bar having equal legs, similar to that shown in FIG. 15 is shown in FIG. 16 too. This latter form of embodiment, for which the same reference numerals as of FIG. 15 have been used, is different from this latter only in that the second extension lengthes 83, 83*a* have in correspondence of their free ends short lengthes 84, 84*a* bent rearwards at a right angle.

In this case, both the width of the second extension lengthes of the legs of the angle iron, and that of said lengthes bent rearwards must be calculated in such a way as to keep unchanged the centre of gravity C.G. of the same section bar. The advantage of such a section bar consists in that it has its edges stiffened and shows hence a higher strength to flexural stresses.

It is to be intended that all the several types of junction elements hereinabove described with reference to the above Figures to exemplifying purposes can be used in combination with an angle iron 80 as shown in FIGS. 15 or 16.

Also the angle iron 80, as the angle iron 10, can be obtained by cold-bending, hot-rolling or extrusion, of steel or of aluminium or of their alloys.

The invention has been disclosed on the basis of some examples of practical embodiment, but it is intended that numerous other executive variants can be accomplished within the scope of the same invention.

I claim:

1. Structure for metal constructions in general and in particular for trestlework constructions comprising at least one angle iron having a pair of generally equal length legs, each leg being extended at a free end thereof by a first extension length positioned at right angles relative to its associated leg and projecting therefrom in the same general direction, a second extension length of each leg positioned at right angles relative to its associated first extension length in such a direction as to depart from each other, said first and second extension lengths having each one a width substantially equal to half the width of a leg of the angle iron, a jointing element constituted by at least one plate, and means for fastening said one plate to said angle iron at an inner surface of one of its legs and to an inner surface of the second extension length of said second leg.

2. Structure according to claim 1, characterized by said first extension lengths having each a width equal to half the width of its associated leg lessened by a value corresponding to the sum of half the thickness of the second extension lengths and half the width of said plate.

3. Structure according to claim 2, characterized in that the second extension lengths of the legs of the angle iron have each a width equal to half the width of a leg of the angle iron increased by the value of said sum.

4. Structure according to claim 2, characterized in that the second extension lengths of the legs of the angle iron have each, in correspondence of its free end, a length bent rearwards at right angle.

5. Structure according to claim 1 or 2, characterized in that said joining element is constituted by said one plate only buttfastened by said fastening means to the inner surface of a first leg of the angle iron and and fastened by said fastening means to the inner surface of the second extension length of the second leg of the angle iron.

6. Structure according to claim 5, characterized in that said one has at one of its ends, with a second plate perpendicular thereto to which it is butt-jointed thereby forming a T-shaped element, said second plate being fastened under plane contact to the inner surface of the said first leg of the angle iron.

7. Structure according to claim 6 characterized in that said second plate is extended in a perpendicular direction on both sides of the first plate and is butt-fastened on one side to the inner surface of the second leg of the angle iron and, on the other side, to the inner surface of the second extension length of the first leg of said angle iron.

8. Structure according to claim 7, characterized in that said second plate is butt-fastened at one of its ends to a further perpendicular plate, and said further perpendicular plate is fastened in contact with the inner surface of the second leg of the angle iron.

9. Structure according to claim 1 or 2, characterized in that the jointing includes a second plate perpendicular to said one plate, and said second plate is fastened to the inner surface of the second extension length of the first leg of the angle iron.

10. Structure according to claim 7, characterized in that the two plates of the jointing element are solid with each other and protrude from two faces of a block having at least two outer faces parallel to the planes of the two plates, and are fastened to the inner surfaces of the two legs of the angle iron.

11. Structure according to claim 10, characterized in that said block has lightening cavities.

12. Structure according to claim 10, characterized in that said block bears solid with itself a further plate positioned on a centre-plane between said two perpendicular plates.

13. Structure according to claim 10, characterized in that the block with its related plates is formed by casting.

14. Structure according to claim 9, characterized in that the two plates of the fastened element are jointed by means of welding beads.

15. Structure according to claim 9, characterized in that the second plate has butt-fastened to it a perpendicular plate in turn fastened to a surface of the first plate of the jointing element.

16. Structure according to claim 9, characterized in that a stiffening rib is provided between the two plates of the jointing element.

17. Structure according to claim 1 or 2, characterized in that the jointing element ends lengthwise with an element adapted for connecting to another angle iron, said end element being adapted to abut against an end of the angle iron.

18. Structure according to claim 1 or 2, characterized in that the plates of the jointing element are fastened to the angle iron by welding.

19. Structure according to claim 1 or 2, characterized in that the plates of the jointing element are fastened to the angle iron by riveting or bolting.

20. A structure for metal constructions in general and in particular for trestlework constructions comprising at least one angle iron defined by a first and second legs of generally equal length and setting-off therebetween an angle of generally 90°, said first and second legs each having a first extension length, said first extension lengths being disposed generally normal to each other and to its associated leg, a second extension length projecting from each first extension length, said second extension lengths being generally normal to each other and to its associated first extension length, a jointing plate, said jointing plate being disposed generally normal to said first leg and generally parallel to said second leg second extension length, first fastening means for fastening said jointing plate to said first leg, and second fastening means for fastening said jointing plate to said second leg second extension length.

21. The structure as defined in claim 20 wherein said jointing plate is in generally butt relationship to said first leg and in generally surface-to-surface contact with said second leg second extension.

22. The structure as defined in claim 20 wherein said jointing plate includes a cross plate imparting a generally T-shaped configuration to said jointing plate, and said first fastening means fasten said cross plate to said first leg.

23. The structure as defined in claim 20 including a further plate bridging said jointing plate and said first leg second extension, third fastening means for fastening said further plate to said jointing plate, and fourth fastening means for fastening said further plate to said first leg second extension.

24. The structure as defined in claim 20 including a further plate bridging said jointing plate and said first leg second extension, an additional plate bridging said jointing plate and said second leg, and means for fastening said further and additional plates to at least said jointing plate.

25. The structure as defined in claims 20 wherein said jointing plate includes a hollow portion and two projecting legs, said hollow portion being disposed generally within said first and second legs and the first extension lengths thereof and said two projecting legs being disposed each generally parallel to an associated one of each of said first and second leg second extension lengths.

26. The structure as defined in claims 20 wherein said jointing plate includes a hollow portion and two projecting legs, said hollow portion being disposed generally within said first and second legs and the first extension lengths thereof, said two projecting legs being disposed each generally parallel to an associated one of each of said first and second leg second extension lengths, and said jointing plate is a casting.

27. The structure as defined in claim 20 wherein said jointing plate includes a hollow portion and three projecting legs, said hollow portion being disposed generally within said first and second legs and the first extension lengths thereof, and two outermost ones of said three projecting legs being disposed each generally parallel to an associated one of each of said first and second leg second extension lengths.

* * * * *